United States Patent [19]

Moellgaard et al.

[11] 4,120,045

[45] Oct. 10, 1978

[54] APPARATUS AND METHOD FOR STEPWISE SCANNING OF PATTERNS ACCORDING TO A SCANNING RASTER

[75] Inventors: Klaus Moellgaard; Ulrich Sendtko, both of Kiel, Germany

[73] Assignee: Dr. Ing. Rudolf Hell, GmbH, Germany

[21] Appl. No.: 726,671

[22] Filed: Sep. 27, 1976

[30] Foreign Application Priority Data

Sep. 27, 1975 [DE] Fed. Rep. of Germany ..... 2543246

[51] Int. Cl.[2] ..... G06K 7/14

[52] U.S. Cl. ..... 364/900; 66/154 A; 139/319; 235/470; 340/146.3 SG; 364/470

[58] Field of Search ... 364/200 MS File, 900 MS File; 358/75-78, 287; 235/151.1, 61.6 H, 61.11 E; 340/146.3 SG; 250/566, 568, 570, 557; 139/317-320, 323; 66/50 R, 50 A, 50 B, 154 R, 154 A, 156

[56] References Cited

U.S. PATENT DOCUMENTS

| | | | |
|---|---|---|---|
| 3,219,974 | 11/1965 | Rabinow | 340/146.3 SG |
| 3,643,010 | 2/1972 | Schunack | 139/319 |
| 3,693,168 | 9/1972 | Halkyard et al. | 364/900 |
| 3,705,292 | 12/1972 | Frappe | 139/319 |
| 3,719,803 | 3/1973 | Frappe | 139/317 |
| 3,760,188 | 9/1973 | Plath | 139/319 |
| 4,019,036 | 4/1977 | Hiramatsu et al. | 235/151.1 |

*Primary Examiner*—Leo H. Boudreau

*Attorney, Agent, or Firm*—Hill, Gross, Simpson, Van Santen, Steadman, Chiara & Simpson

[57] ABSTRACT

Apparatus and a method for converting patterns for weaving into stored information by scanning according to a scanning raster the pattern and determining the number of steps per stitch of the scanning raster by using the quotient of the dimensions of the scanned pattern divided by the number of stitches in the same direction and wherein such quotient is used such that at equality or upon a known deviation from a prescribed fraction of a step a signal is generated which indicates the beginning of the next stitch and wherein a greater deviation than said prescribed one the signal is given after a further step has been accomplished.

19 Claims, 7 Drawing Figures

APPARATUS AND METHOD FOR STEPWISE SCANNING OF PATTERNS ACCORDING TO A SCANNING RASTER

BACKGROUND OF THE INVENTION

1. Field of the Invention

This invention relates in general to weaving processes and apparatus and in particular to a stepwise scanning of patterns according to a scanning raster.

2. Description of the Prior Art

Textile fabric patterns are expressed by the variations in the color of the fabric determined by the color pattern or zone and by the texture resulting from the cross-weaving of the fabric as, for example, the manner of joining and looping of the warp and weft threads of the pattern. Initially, an artist prepares a drawing illustrating the color and texture of the fabric which it is desired to be produced. The inking of the colors does not occur until the weaving process wherein the corresponding yarns are selected, but the texture of the weave must be taken into consideration during the preparation of the control data. The pattern which is designed exclusively according to the artistic aspects, is therefore converted into a weavable pattern from which the weaving technique structure of a fabric can be accomplished. For this purpose, in a second process, a technical fabric textile drawing also called a point paper design is prepared from the pattern design. The drawing is reproduced on pattern paper printed with an orthogonal raster network. The space between two horizontal raster lines is called the weft line and between two vertical raster lines the warp line. In the subsequent fabric at least one weft thread runs in the weft line and at least one warp thread in the warp line. Each raster stitch (loop, mesh) of the pattern element represents a crossing point between the warp and weft threads. The interval of the raster lines from one another corresponds to the warp-/weft ratio which is a criteria of the fineness of the fabric.

In practice, the entire pattern design is generally not converted into a point paper design but rather only a pattern repeat wherein the term "pattern repeat" is to be defined as the smallest regularly recurring pattern detail.

The transfer of a pattern repeat occurs by means of filling out or leaving free pattern elements and whereby curved lines of the pattern design are approximately weaved by step-shaped contours. There are two different embodiment forms of the point pattern design with one embodiment comprising a fully drawn out completed point paper design in which all thread crossing of the warp and weft are exactly entered in the raster network. A pattern element which is blacked in means, for example, a warp raising; and blank pattern elements represent a warp lowering. During the scanning of such point pattern design, therefore, only a black-white decision must be made.

The second embodiment comprises a point paper design produced without ties in which the point paper design pattern elements associated with a fabric zone with the same tying effect are characterized by color. This requires the indication of the tying information associated with each pattern color. If various tying effects occur in a fabric pattern the point pattern design contains different colors which must be recognized and evaluated during the scanning of the point pattern design.

In a third pattern step, the color data is obtained with the use of a point pattern design scanning device.

In a known self-acting point pattern design scanning device, the point pattern design prepared from a weaving pattern design is attached to a rotating scanning drum and scanned pattern element by pattern element by a light dot by a scanning instrument means which is movable parallel to the scanning drum. The scanning takes place on circular circumferential lines of the scanning drum which run centrally between two vertical raster lines. After the scanning of a circumferential line, the scanning instrument means is shifted axially for a distance interval between two circumferential lines and subsequently the next circumferential line is scanned.

The light reflected from the point paper design into the scanning instrument means is converted into opto-electrical analog signals which are fed to a color recognition circuit. The color recognition circuit converts the color information read from each pattern element into a color signal which is transformed by digitalizing into color data for each pattern element. The color data is then stored in a digital storage device.

In a fully completed point pattern design the stored data constitutes the control data for the weaving process. If conversely, a point pattern design which was drawn without the ties being indicated were scanned, the control data for the weaving process will be formed from the scanned color data and the separately stored tying information. The control data is transferred to data carriers in the form of punch tapes, jacquard cards, film strips or magnetic tapes or magnetic discs which ultimately control the work cycle of the weaving machine.

In order to achieve a high recognition accuracy of the point pattern design, color of a design element during scanning of a point pattern design with the aid of an automatically scanning point pattern design scanning device, the contours of each pattern element must be very exactly filled in with color so that the scanning optics can derive unequivocal information at the particular scanning point. The point pattern design drawing must therefore be executed with extreme accuracy and care. This process is very expensive and time consuming and accurate reproductions cannot be made by the weaving machines if the design elements vary by as much as 1 millimeter in very fine textile patterns.

The accuracy in the recognition of a color can also be increased in the case of an inexactly drawn point paper design if the information in each case read by the scanning instrument means is that information at the center of a pattern element. At such center point, the color inking is surely present.

In an automatically functioning point paper design scanning mechanism in which the scanning mechanism as described executes equidistant advancing steps, a central scanning of the pattern elements can, however, only be achieved if the raster network imprinted on the drafting paper is exactly and precisely executed and the point paper design pattern is accurate in size.

These requirements do not exist in practice. The imprinted raster network is often imprecise and conventional drafting paper is not distortion free. Where the work is not carried out in air-conditioned rooms, temperature fluctuations and humidity changes lead to an undesired length alteration in the point pattern design pattern which can be up to 10 millimeters in the case of an ordinary repeat length of one meter. If, however, as already mentioned the edge length of a pattern design element amounts to about 1 millimeter, it is seen without difficulty that a central scanning of each pattern will not be guaranteed. An additional consideration is that the drafting paper is distorted by varying moisture distribution because of an uneven application of the drafting color inks in the point position design production.

Furthermore, thicker marking lines are often additively inserted into the raster network with results that there are no equidistant points of intersection present or a raster network is completely lacking. The above difficulties can be partially avoided by the use of expensive but more true to size plastic foil for use as the drawing carrier for the point pattern design so that it is possible to operate with a constant step width of the scanning instrument device. Such plastic foil, however, provides a poor adhesion base for the drafting colored ink and a uniform color application can only be achieved with difficulty. The requisite time for preparing the drawing on a plastic foil is thus considerably higher than that required with normal drafting paper. In order to keep the drafting time short and to be able to operate economically, it is desired to continue the present practice of using cheaper drafting paper and to avoid the disadvantages of said cheaper drafting paper by suitable means.

Prior art devices are known which attempt to compensate for the disadvantages of using conventional drafting paper.

In West German Patent OS No. 2,154,878 a device is described in which an auxiliary scanning instrument is utilized beside the main scanning instrument which reads the information on the point paper design. The auxiliary scanning instrument scans a scale arranged outside the point pattern design whose division in each case is located centrally of two vertical raster lines of the point pattern design. With a corresponding alignment of both scanning instruments the auxiliary scanning instrument always generates a control pulse when the main scanning instrument is located in the center of a pattern element. At this time, the control pulse causes the main scanning instrument to derive a sample from the point pattern design.

It is further proposed to scan the vertical raster lines of the point paper design pattern itself with the auxiliary scanning instrument. This method presupposes that a raster network is present and that the available raster network is very well constructed so that recognition is possible.

Another device is described in German Patent OS No. 2,204,710 which contains an auxiliary scanning instrument for producing a control pulse by scanning vertical raster lines. In order to avoid the emission of a control pulse when the raster lines are insufficiently expressed, a pulse generator is additionally provided which is synchronized with the control pulses in such a way that it generates auxiliary pulses at the same rhythm as the control pulses. When a control pulse is absent because a raster line is not identified, the auxiliary pulse establishes the point in time of the scanning.

German Patent OS No. 2,023,607 discloses a process in which a longitudinal strip of the point pattern design is provided with a raster network which is maintained free of ink registrations and is separated from the pattern just before the scanning and clamped into an auxiliary device. This longitudinal strip is then also scanned by an auxiliary scanning instrument so as to obtain control pulses.

Instead of printed raster lines magnetic lines can also be applied to the point pattern design and can be scanned with a corresponding scanning device.

In the above mentioned processes, a raster network is a prerequisite where all raster lines or at least the majority of the raster lines are strongly expressed. Raster lines which are barely visible have to be retraced by hand. The main and auxiliary scanning instruments must be precisely aligned.

In German Patent OS No. 2,424,457 a scanning process is described in which the scanning instrument is automatically shifted in the warp direction independent of printed raster lines and of possible dimensional fluctuations in the point paper pattern. In the scanning device described therein, the point pattern design is attached to the scanning drum in such a way that the weft line runs in the circumferential direction and the warp lines in the scanning direction. During scanning, the scanning drum rotates continuously and the scanning instrument carries out a stepwise axial advancing movement by means of a stepping motor wherein each case after the scanning of a weft line a partial shifting to the next line occurs. For determining the magnitude for partial shifting, the integral quotient is formed before scanning from the number of motor pulses which occur during the length of the point pattern design in the warp direction and from the number of stitches in the step direction. The integral quotient is the specified nominal quantity for the control of the stepping motor.

The motor pulses actually emitted during the advancing movement of the scanning instrument are counted as the actual magnitude and compared to the nominal magnitude and when these are equal the partial adjustment and the counting cycle are ended by resetting the counters.

The above explanations relate to prior art means for obtaining data for operating weaving machines. Similar problems also exist in the generation of control data for other textile processing machines.

SUMMARY OF THE INVENTION

The present invention has a principle object of providing a scanning process which has a greater scanning accuracy than that achieved by devices of the prior art and in which the warp-weft-ratio can be freely selected.

Other objects, features and advantages of the invention will be readily apparent from the following description of certain preferred embodiments thereof taken in conjunction with the accompanying drawings although variations and modifications may be effected without departing from the spirit and scope of the novel concepts of the disclosure and in which

DESCRIPTION OF THE PREFERRED EMBODIMENTS

Figure 1:
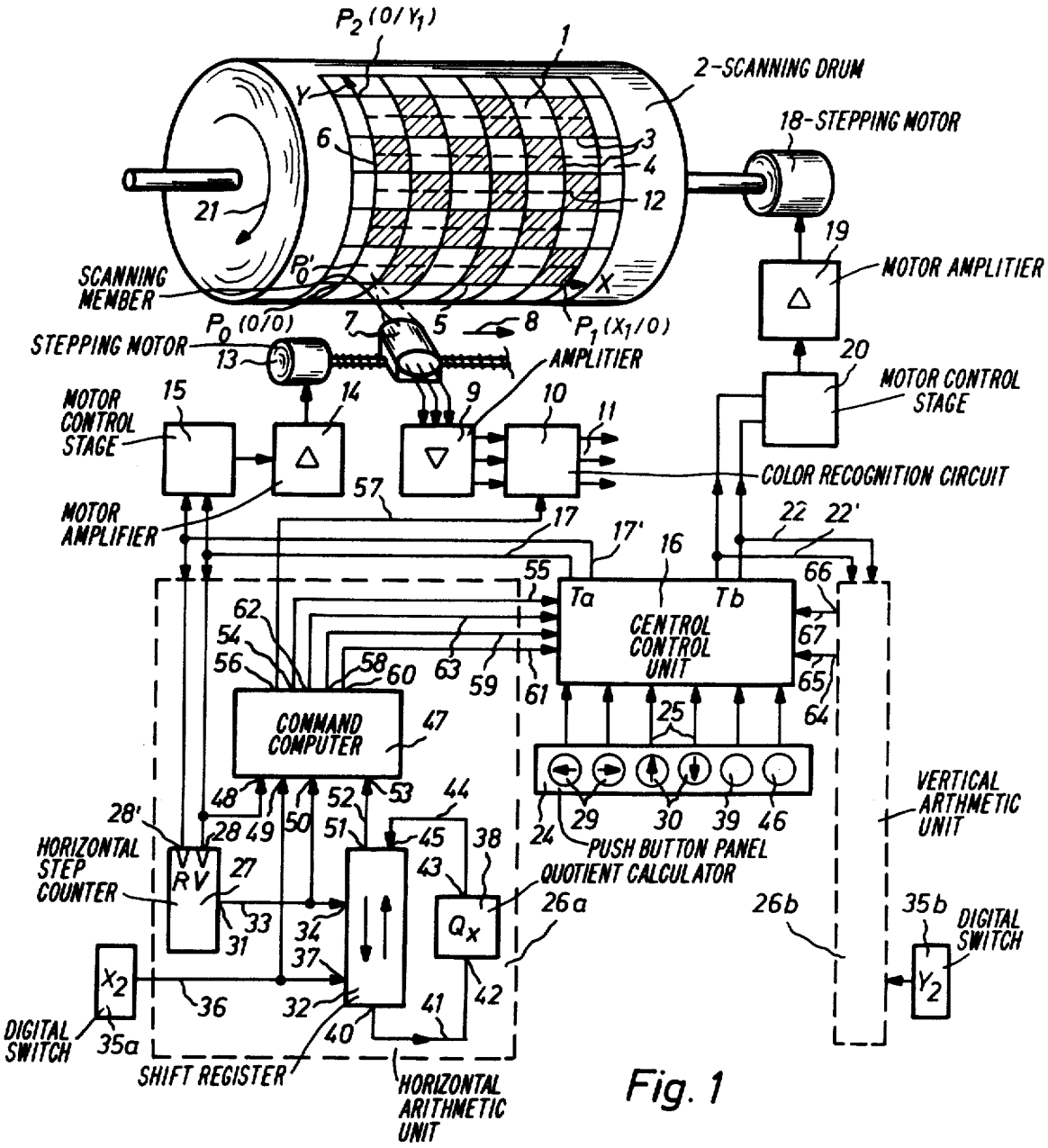
FIG. 1 is a functional block diagram of a point paper design pattern scanning device.

FIG. 1 is a block circuit diagram of the invention and illustrates a point pattern design 1 which is attached to the cylindrical pattern carrier comprising a cylindrical scanning drum 2 which is driven in the direction of the arrow 21 by a stepping motor 18. It is to be realized, of course, that although a cylindrical scanning drum is illustrated in the invention, a flat pattern carrier could also be utilized.

The point pattern design 1 has formed thereon a pattern repeat of a textile pattern and is prepared on normal non-distortion free point pattern design paper. The individual pattern elements 4 bordered by the raster lines 3 of an orthogonal raster network contain the specific weaving technical information in the form of point pattern design color which can be recognized by the point pattern design scanning device. For the sake of clarity only a few pattern elements are illustrated. Also, a coordinate system is formed on the point pattern design 1 with the X-axis in the particular example coinciding with the horizontal raster line 5 bordering the repeat pattern in a circumferential direction and the Y-axis coinciding with the vertical raster line 6 bordering the repeat pattern in the axial direction.

The lower corner of the first design pattern element 4 corresponds to the coordinate $P_0$. The repeat length $x_1$ in the direction of the X-axis is established by the pints $P_0$ and $P_1$ and the repeat length $y_1$ in the direction of the Y-axi is established by the points $P_0$ and $P_2$. If no raster network is present in the point pattern design the coordinate axes constitute the reference edges of the pattern repeat.

The point paper design is carefully aligned on the scanning drum 2 in such a way that the X-axis runs very precisely on a altitude line normal to the circumferential line and the Y-axis runs on a circumferential line of the scanning drum 2.

The point pattern design 1 is scanned linewise, pattern element by pattern element in the direction of the arrow 8 by a scanning member 7 which is moved axially along the scanning drum 2.

During scanning, the scanning light of the scanning instrument is reflected from the point pattern design 1 and is opto-electrically converted into analog signals which are fed to an amplifier 9 and to a color recognition circuit 10. From the detected color information the color recognition circuit 10 produces corresponding color signals which are available at its output for further processing.

The scanning lines are indicated by broken lines 12 and run in each case centrally between two horizontal raster lines. The beginnings of the scanning lines are on the Y-axis.

The information pickup from the pattern elements 4 is always to occur when the optical axis of the scanning member 7 is approximately in the center of a pattern element 4.

The axial shift of the scanning member 7 is accomplished by a stepping motor 13 which is controlled by a pulse train sequence $T_a$ through a motor amplifier 14 and a motor control stage 15. The pulse sequence $T_a$ is generated by a central control unit 16 and during the advancing movement of the scanning member 7 in the direction of the arrow 8, the pulse train $T_a$ passes through line 17 or for a return movement in the opposite direction through line 17' to the motor control stage 15.

The stepwise rotational movement of the scanning drum 2 occurs with the stepping motor 18 which is controlled by a pulse train sequence $T_b$ through a motor amplifier 19 and a motor control stage 20. The pulse sequence train $T_b$ is also generated in the central control unit 16 and is fed to the motor control stage during rotation of the scanning drum in the direction of the arrow 21 through line 22 or in the case of rotational movement in the opposite direction through a line 22'.

For adjusting the point paper design pattern scanning device the advancing movement of the scanning member 7, the rotational movement of the scanning drum 2 and further functions to be later described can be manually controlled by activating corresponding buttons of a push button panel 24 which has a plurality of push buttons such as the push buttons 29, 30, 39 and 46. The push button panel 24 is connected to the central control unit by control lines 25.

As explained above, the point pattern design 1 which is to be scanned is drawn on normal inaccurate pattern drafting paper. The pattern repeat length $x_1$ and the pattern repeat width $y_1$ may deviate from the desired accurate dimensions on the basis of the linear length alterations. In the present invention, the stepping motors and the evaluation of the color signals are controlled in such a way during scanning that the information is picked up from all pattern elements from the center of such elements and is assured so that a high degree of recognition accuracy is obtained. For determining the control commands, a horizontal arithmetic unit 26*a* and a vertical arithmetic unit 26*b* are provided. The process for determining the control commands to be carried before scanning of the point paper design 1 and the mode of operation of the arithmetic units 26*a* and 26*b* will be explained by using the block diagram of FIG. 1. The horizontal arithmetic unit 26*a* will be described in detail and it is to be realized that the vertical arithmetic unit 26*b* is constructed identical to the horizontal arithmetic unit 26*a*.

The first step of the process consists in measuring the repeat lengths $x_1$ which deviates from the specified dimension with the aid of the scanning member 7 just before the scanning of the point pattern design 1. For obtaining the measurement results, a horizontal step counter 27 is associated with the stepping motor 13 and the counter 27 comprises a forward-backward counter. The forward counting input 28 is connected to the line 17 and the backward counter input 28' to the line 17'.

In the advancing movement of the scanning member 7 in the direction of the arrow 8, the forward counting input 28 receives the pulse train sequence $T_a$ and the horizontal step counter 27 counts the number of advancement steps of the stepping motor 13. In the case of advancement in the reverse direction, the pulse train sequence $T_a$ is applied to the backward counter input 28' and the number of backward steps are counted. The counter reading "$x$" of the horizontal step counter 27 indicates the position of the scanning instrument on the X-axis. When the counter reads "zero" the scanning member 7 is located at the coordinate point zero $P_0$ and when the counter reads "$x_1$" the scanning member 7 will be located at point $P_1$. In the particular embodiment illustrated a counting unit corresponds to an advancement step of 0.1 mm.

It is proved advantageous to determine the actual dimensions of the point paper design pattern 1 with the aid of the scanning member 7. Since the measurement and scanning are done with the same apparatus, errors which are peculiar to the particular device will be eliminated using this system.

For measuring the repeat length $x_1$, the scanning member 7 and scanning drum 2 are shifted relative to each other in such a way by the use of the stepping motors 13 and 18 that the optical axis of the scanning instrument 7 initially exactly coincides with the coordinate zero point $P_0$. At this position, the resetting of the horizontal step counter occurs.

Subsequently, the scanning member 7 is positioned exactly onto point $P_1$ by advancing it in the direction of the arrow 8. The advancement control of the scanning member 7 and the control of the rotational movement of the scanning drum 2 occurs by activating the push buttons 29 and 30 of the push button panel 24 by the operator and the direction of movement is indicated by corresponding symbols on the respective buttons.

For fine positioning of the scanning member 7 to points $P_0$ and $P_1$ individual steps of the stepping motors can be accomplished by one step push buttons.

For further operational control the scanning member 7 can be equipped with a specular reflecting device such as a mirror reflection regular reflection device consisting of a viewing hood with a ground glass plate, a magnifying glass and a passive reflector. If the passive reflector is located in the beam path, then the region picked up by the scanning optical system is depicted on the ground glass plate and can be observed in magnified form through the magnifying glass by the operator. Cross hairs as a reference mark may be located on the ground glass plate for example and the image point will be depicted and can be precisely located at the optical axis of the scanning member 7 at that instant.

During the measurement operations, the horizontal stepping counter 27 will have counted as a five-digit decimal number, the number $x_1$ of the stepping motor 13 advancement steps which were necessary for moving through the measurement distance and the results will appear as binary coded data $x_1$ at the output 31 of the horizontal step counter 27. The data $x_1$ will be stored in a shift register 32 and for this purpose, the output 31 of the horizontal step counter 27 is connected by line 33 to a first data input 34 of the shift register 32.

By use of a digital switch 35*a*, the operator can additionally set in as a three-digit decimal number the prescribed number $x_2$ of pattern elements 4 per scanning line or, respectively, of raster lines of the scanning raster which correspond to the repeat length $x_1$. This number is also supplied as binary coded data $x_2$ in the shift register 32. For this purpose, the digital switch 35*a* is connected by line 36 to a data input 37 of the shift register 32.

During the next process, the number of advancement steps of the stepping motor 13 required to be carried out for each pattern element 4 is determined as a quotient $q_x$ from the measured repeat length $x_1$ of the point paper design pattern 1 and from the prescribed number $x_2$ of the pattern elements 4.

The quotient $q_x$ is equal to $x_1/x_2$ and is calculated in a quotient calculator 38. In order to carry out the arithmetical operation, which is initiated by pushing the button 39 "quotient formation" of the push button panel 24, the transfer of data $x_1$ has the dividend and later the transfer of data $x_2$ as divisor is supplied as the first data input 40 of the shift register 32 through line 41 to the data input 42 of the quotient calculator 38. All of the information in the shift register 32 is thus read out. The ascertained quotient $q_x$ is written into the shift register 32 by way of a data output of the quotient calculator 38 through line 44 and to data input 45 of the shift register 32.

Subsequently, the repeat height $y_1$ is measured between points $P_0$ and $P_2$ by the use of the scanning member 7. Simultaneously, the operator sets the number $y_2$ of the pattern elements 4 which have the repeat height $y_1$ on the digital switch 35*b*. When this measurement of the point paper design pattern 1 has been completed, the actual scanning can be started. The scanning member 7 is moved to the point $P'_0$ of the first scanning line by actuating the push buttons 29 and 30 of the panel 24 and then the push button 46 "scan" of the push button panel 24 is actuated. For determining the control commands during the scanning of the point paper design pattern 1, a command computer 47 is provided.

The following control information is supplied to the control inputs of the command computer 47. The pulse train sequence $T_a$ passes through line 17 to a first control input 48. The specified number $x_2$ of pattern elements 4 is supplied to a second control input 49 through line 36. A third control input 50 of the command computer receives the running counter reading "$x$" of the horizontal step counter 27 through line 33. The quotient $q_x$ stored in the shift register 32 passes from a second data output 51 of the shift register 32 to a fourth control input 53 of the command computer 47 through line 52.

As the linewise scanning of the point paper design pattern 1 is being accomplished, the specific number of advancement steps of the scanning instrument from the beginning line to the vertical raster line of the scanning raster is continuously determined in the command computer 47 and each time after a raster line has been crossed by the scanning member 7 the quotient $q_x$ is summed.

The result of such summing is constantly compared to the counter reading "$x$" of the horizontal step counter 27. When the counter readings "$x$" corresponds to the summation results, the command computer 47 generates a control command "scanning raster" which is fed to the central control unit 16 from the output 54 through a line 55.

This control command "scanning raster" appears whenever the scanning member 7 has scanned a pattern element 4 during the axial advancement, or defines a "fictitious scanning raster" if an unrastered pattern design is scanned instead of a rastered point pattern design pattern.

The advantage of this method thus consists in the fact that no raster lines are necessary on the point paper design pattern in order to dictate exact scanning positions to the scanning member 7.

The command computer 47 additionally generates control commands "information pickup" which set the points in time at which color information is to be derived from the pattern elements 4. The control commands are fed to the color recognition circuit 10 from a further output 56 of the command computer 47 through a line 57. Since on one hand the quotient $q_x$ which represents a standard criteria for the exact length of a pattern element 4 can be a decimal fraction; but on the other hand the length of the pattern element 4 can only be approximated as a multiple of an advancement step, the advancement error resulting therefrom must be compensated by correctional advancement steps for which purpose the command computer 47 generates a control command "correctional step" which is fed to the central control unit 16 from a third output 58 of the command computer 47 through a line 59.

When the control command "correctional step" is generated an additional pulse from the pulse train sequence $T_a$ is fed to the motor control stage 15 from the command computer 47 after a fixed number of pulses have been supplied by the pulse train sequence $T_a$ which corresponds to the integral part of the quotient $q_x$. As a result of the additional pulse, the stepping motor 13 produces an additional correctional advancement step. In this case, the control signal "scanning raster" is not triggered until after this correctional step so that the scanning raster according to the inventive concept is automatically adapted to the actual repeat length of the point paper design pattern 1.

From the comparison of the prescribed number $x_2$ of pattern elements 4 per scanning line with the result of the constantly executed multiple addition of the quotient $q_x$ a further control command "line end" is derived in the command computer 47 and this control command is fed to the central control unit 16 from an output 60 of the command computer 47 through line 61.

The control command "line end" after the scanning of the last pattern element of the first scanning line, triggers the return of the scanning member 7 to the beginning of the second scanning line. For this purpose, axial shifting of the scanning member 7 in the direction opposite to the arrow 8 and an angle step of the scanning drum 2 in the direction of the arrow 21 are required.

The rotational direction reversal of the stepping motor 13 for the axial shifting of the scanning mechanism is caused by supplying the pulse train sequence $T_a$ to the motor control state 15 by way of the line 17' instead of through line 17.

During the return of the scanning member 7, the backward counting input 28' of the horizontal step counter 27 receives the pulse train sequency $T_a$ and the horizontal step counter 27 counts back to zero.

The counter reading "$x$" is coded out in the command computer 47 and at a counter reading of zero, the command computer 47 produces a control command "line beginning" from a further output 62 of the command computer 47 to the central control unit 16 by way of line 63 which command terminates the return of the scanning member 7.

For the carrying out of the angle step of the scanning drum 2 the control command "line end" releases the pulse sequence $T_b$ which starts the stepping motor 18 and the vertical step counter of the vertical arithmetic unit 26b.

During the stepping movement of the scanning drum 2, the previously calculated quotient $q_y$ is constantly compared to the counter reading of the vertical step counter. When these are equal, a control command "stop" for the stepping motor 18 is generated which command is fed to the central control unit 16 from an output 64 of the vertical arithmetic unit 26b through line 65.

After the control command "line begin" and also the control command "stop" appear, the scanning member 7 will be located at the beginning of the second scanning line and the scanning can be continued.

For further angular step adjustments of the scanning drum 2 after the scanning of a line the calculated quotient $q_x$ is continuously summed and the results are compared with the counter reading "$y$" of the vertical step counter for obtaining the "stop" control command.

In the vertical arithmetic unit 26b the number of the executed angle steps of the stepping drum 2 is compared with the number $y_2$. When these factors are equal, the vertical arithmetic unit 26b generates a further control command "scanning end" which is fed to the central control unit 16 through a further output 66 of the vertical arithmetic unit 26b through a line 67. When the command "scanning end" appears, the color information of the last pattern element will also have been obtained and the scanning of the entire point paper design pattern 1 will have been concluded.

Figure 2:
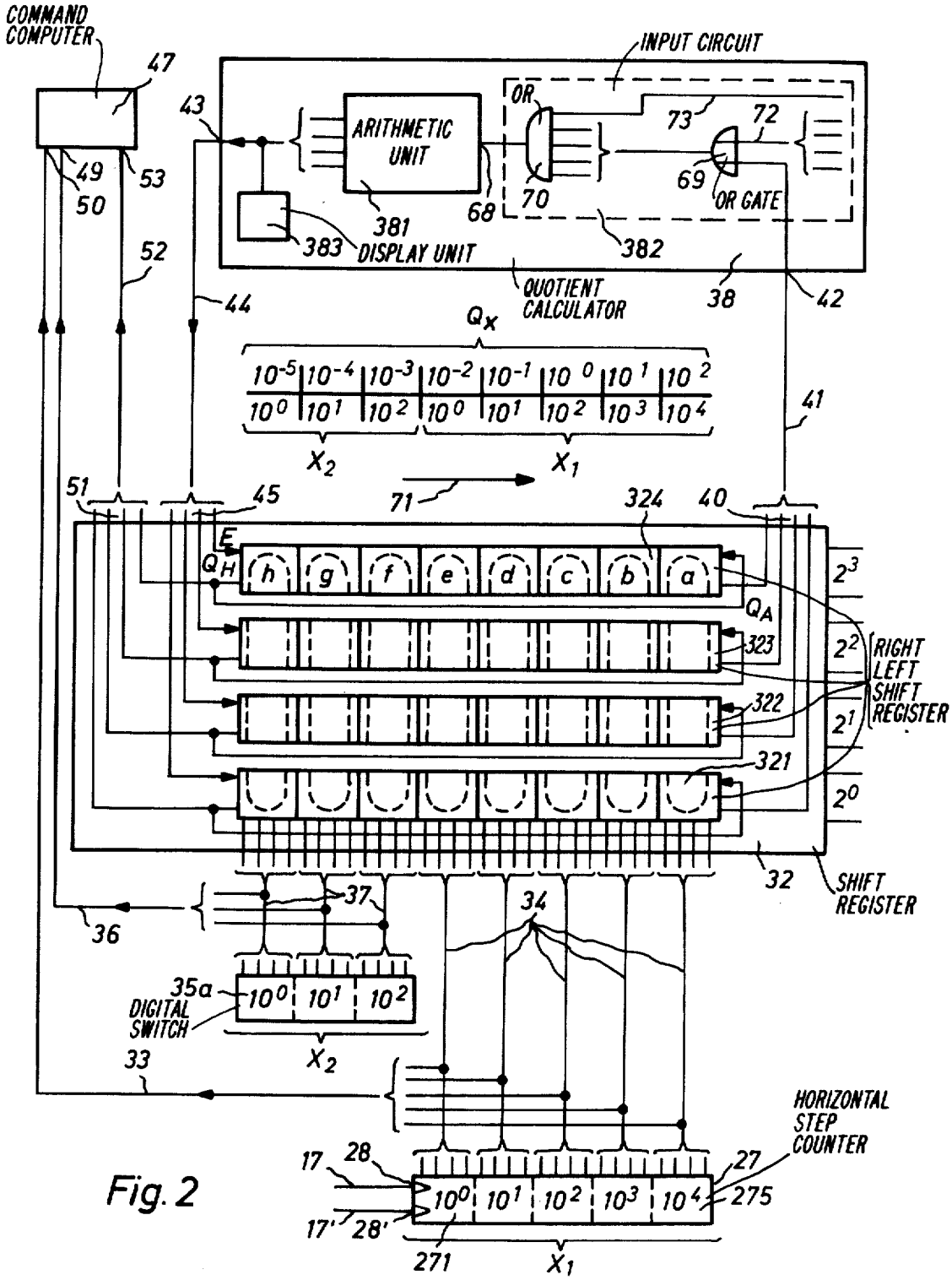
FIG. 2 is a partial detailed circuit diagram of the horizontal arithmetic unit.

FIG. 2 illustrates a detailed respresentation of a part of the horizontal arithmetic unit 26a with a horizontal step counter 27, the digital switch 35a, the shift register 32 and the quotient calculator 38.

The horizontal step counter 27 is constructed of five counter units 271 to 275 connected in cascade and each of the counter units corresponds to a power of 10 between $10^0$ to $10^4$ of the five-digit decimal number $x_1$. A counter unit consists, for example, of forward-backward decimal counters such as type 74192 available from Texas Instruments Corporation. Such component elements are available commercially and are known to those skilled in the art.

Each counter unit operates in the 8421-BCD-code and represents counted-in digits between 0 and 9 at its output as a four digit binary number. When the decimal "10" appears, a carry over to the higher value counter unit occurs.

The digital switch 35a includes a coding switch which converts the selected digits of the decimal number $x_2$ into three binary numbers of 4 bits each also according to the 8421-BCD-code.

The shift register 32 is constructed of four components 321 to 324 and each component unit may be, for example, an 8-bit right-left shift register such as the type 74198 model available from Texas Instruments. The binary orders of $2^0$ to $2^3$ are allocated to the component units 321 to 324. The connection of the four component units 321 to 324 to the shift register 32 is depicted in simplified form. A component unit has eight storage locations and the output of the first storage location is designated as $Q_a$ and the output of the highest storage location as $Q_h$. All of the outputs $Q_a$ constitute the output 40 of the shift register 32 and all outputs $Q_h$ form the output 51 from the shift register 32. The inputs of the component units for the shift direction "right" are the inputs 45 of the shift register 32. Each output $Q_h$ is connected to the assigned serial input for the shift direction "left" so that the information appearing at output 51 is again re-entered into storage through the serial inputs (ring counters). Corresponding equal rank storage locations of the four component units are combined to form eight storage regions "*a*" through "*h*" of 4 bits each to which in each case a decimal order is assigned. The assignment of the orders is as indicated in the table of FIG. 2. By using a parallel data transfer, the five decades of the decimal $x_1$ are supplied into the storage regions "*a*" through "*e*" by way of the inputs 34 of the shift register 32 and the three decades of the decimal number $x_2$ are supplied through input 37 into the storage regions "*f*" through "*h*".

The quotient calculator 38 consists of the arithmetic unit 381, an input circuit 382 and a display unit 383 on which the calculated quotient $q_x$ is displayed. The arithmetic unit 381 includes a DCD computer, for example, of type TMS 0117 NT available from Texas Instruments Corporation. In the arithmetic unit 381 the input data are input serially as 5 bit words by way of the data input 68. Four of the bits form the operands for the arithmetic operation to be carried out to form a command code. The fifth bit determines, as "a control bit", whether the 4 bit information is to be interpreted as operand or command. An operand can be a 1 to 10 digit decimal number.

If the mantissa is less, corresponding zeros must be added. In the present case a division is to be carried out and the following are supplied as inputs into the arithmetic unit 381. A first five-digit decimal number as the dividend, a division command and a three-digit decimal number as the divisor. The decimal point will be between the decades $10^0$ and $10^{-1}$. For the transfer of dividend and divisor from the shift register 32 into the arithmetic unit 381, the outputs 40 of the shift register 32 are connected to the serial data input 68 of the arithmetic unit 381 by way of line 41 and OR gate 69 and a second OR gate 70 of the input circuit 382. First the decimal number $x_1$ to be used as the dividend is transferred into the arithmetic unit 381 and decade by decade beginning with the data of the highest value decade and the highest bit value are shifted out of the shift register 32 in the direction of the arrow 71 and the last five decades are added as zeros by way of line 72.

Simultaneously, the decimal number $x_2$ is also shifted in the direction of the arrow 71 and after completion of the transfer of the decimal number $x_1$ into the arithmetic unit 381 it will be located in the storage regions "*a*" through "*c*" of the shift register 32.

The input of the calculation command "division" by way of the line 72 is then furnished and a corresponding control bit is added by way of line 73 for characterizing the command.

Subsequently, the decimal number $x_2$ which is to be used as the divisor is emitted from the shift register 32 by way of line 41 in the direction of the arrow 71 and is entered into the arithmetic unit 381. In the process two preceding and five following zeros are supplemented by way of line 72. After completion of this operation, the entire information has been ejected from the shift register 32.

When the command "result formation" which passes to the arithmetic unit 381 by way of line 73 causes their arithmetic unit to perform the division. The calculated quotient $q_x$ will be an eight digit decimal number with three digits before and five digits after the decimal point and the decimal number will initially be stored in the shift register 32.

The output of the calculated results occurs serially for each decade and in each case the decade-characterizing word of 4 bits appears in parallel at the data output 43 of the arithmetic unit 381. Beginning with the highest value decade $10^2$ of the quotient $q_x$ each word is entered into a storage region of the shift register 32 through the input 45 in the direction of the arrow 71. In this process, the leading zeros fall out.

After execution of this operation, the highest value decade $10^2$ of the quotient $q_x$ will be located in the storage region "*a*" and the lowest value decade $10^{-5}$ will be located in the storage region "*h*" of the shift register 32.

With this operation, the quotient formation is concluded and scanning of the point paper design pattern 1 can commence. During scanning, the command computer 47 determines the corresponding control commands which will be described in greater detail later.

Figure 3:
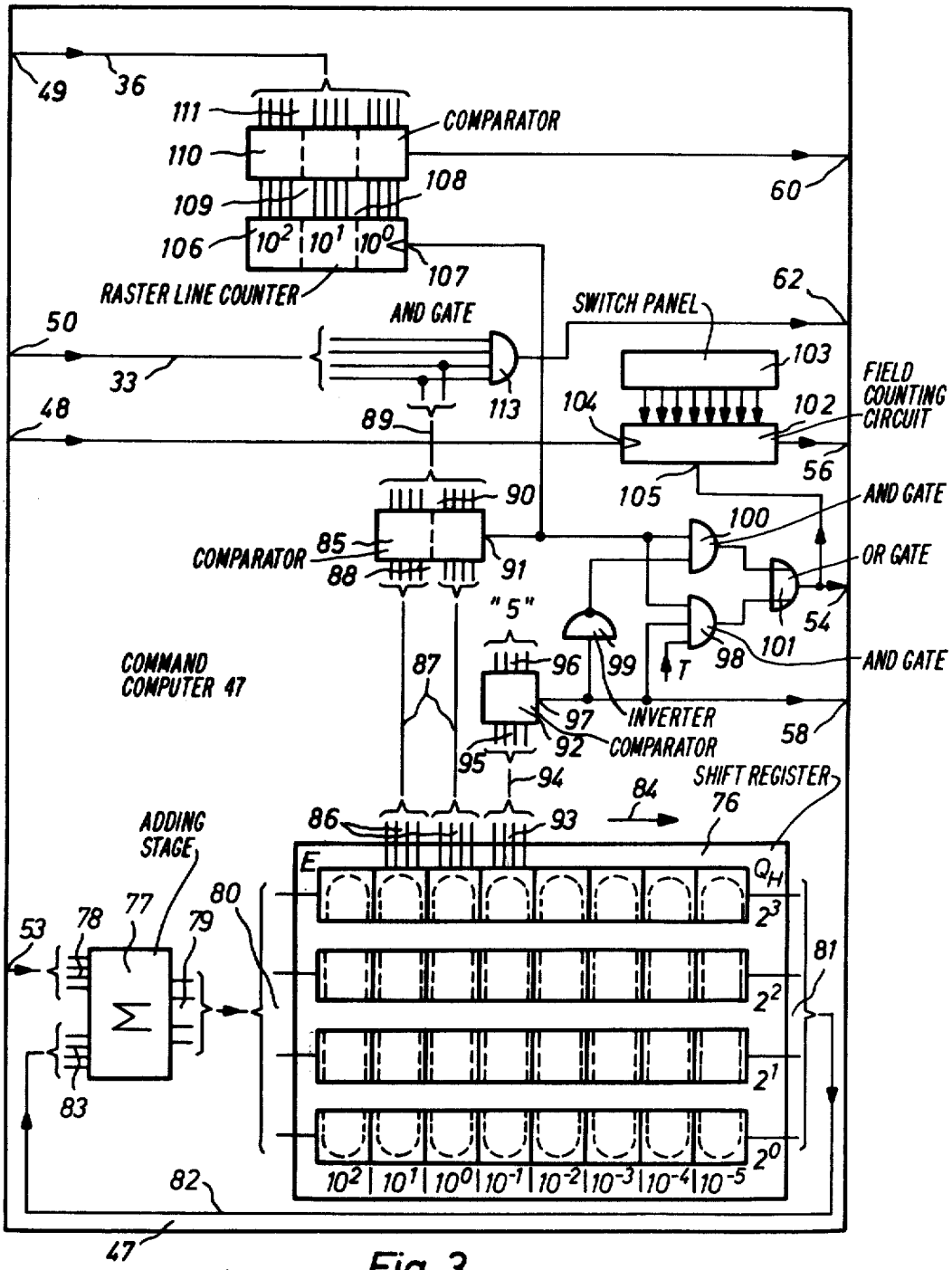
FIG. 3 is a detailed circuit diagram of the command computer in the horizontal arithmetic unit.

FIG. 3 illustrates a sample embodiment of the command computer 47. The calculated quotient $q_x$ is continuously summed after each pass over a pattern element 4 of the point paper design pattern 1 by the scanning member 7 in the direction of the arrow 8. For that purpose a further shift register 76 and an adding stage 77 are provided in the command computer 47. The shift register 76 is constructed the same as the shift register 32. The outputs 51 of the shift register 32 are connected to the first input 78 of the adding stage 77 by way of lines 52 and by way of the input 53 of the command computer 47. The sum output 79 of the adding stage 77 is connected to the serial input 80 of the shift register 76. The serial output 81 of the shift register 76 is returned through a line 82 to a second input 82 of the summing or adding stage 77.

For addition, the quotient $q_x$ is steadily supplied decade by decade from the shift register 32 in the opposite direction from the arrow 71 and is fed to the adding stage 77 as a first summand. Since the shift register 76 has no information stored in it at the beginning of the summing up period, the second summand present at the second input 83 of the adding stage 77 will be equal to zero and the result of the first addition is the quotient $q_x$.

The result of the addition is written into the shift register 76 decade by decade in the direction of the arrow 84. The control command "scanning raster" initiates the second addition operation and to that end the quotient $q_x$ is continuously read out of the shift register 32 and in a direction opposite arrow 71 (FIG. 2) and out of the shift register 76 in the direction of the arrow 84 (FIG. 3).

Since the quotient $q_x$ is now present at both inputs 78 and 83 of the adding stage 77, the result of the second addition will be $2q_x$ which is in turn stored in the shift register 76. During the advancing movement of the scanning device 7 in the direction of the arrow 8, the described addition operation will be steadily continued.

For comparing the respective addition results with the running counter reading "*x*" of the horizontal step counter 27, a comparator 85 is provided which is constructed, for example, of two units of type SN 7485 connected in cascade. For determining if equality exists in each case, it is only necessary to evaluate the decades with the orders (significance) $10^1$ and $10^0$ of the magnitudes to be compared. For this purpose, the parallel outputs 86 of the storage regions "*b*" and "*c*" of the shift register 76 are connected by way of line 87 to the A inputs 88 and the associated equivalent outputs 31 of the horizontal step counter 27 (FIG. 2) are connected by way of line 89 to the B-inputs 90 of the comparator 85. When the information is equal at the inputs of the comparator 85, the signal output 91 will be supplied into the H region. In the command computer 47, a further comparator 92 is present which checks whether the decade with the order "significancce" $10^{-1}$ of the stored addition results is greater than or equal to "5". For this purpose, the output 93 of the storage region of the shift register 76 is connected by way of line 94 to the A-input 95 of the comparator 92 and the number "5" remains stored at the B-inputs 96. If this condition is fulfilled an H signal which corresponds to the control command "correctional step" will appear at the signal output 97.

The signal output 97 of the comparator 92 is connected to one input of an AND gate 98 and to an input of a further AND gate 100 through an inverter 99. The signal output 91 of the comparator 85 is connected to a further input of the AND gate 98. The AND gate 98 also has an auxiliary pulse sequence T' applied to it which is synchronized with the pulse train sequence $T_a$. The outputs of the AND gates 98 and 100 are conveyed to an OR gate 101 whose output 54 comprises the control signal "scanning raster". An L signal at the signal output 97 of the comparator 92 (no correctional step) primes the AND gate 98. If the signal output 91 of the comparator 85 passes into the H region, then the control command "scanning raster" synchronously appears at the output 54.

With an H signal at the signal output 97 (correctional step), when the AND gate 100 is primed, and when the control command "scanning raster" is not produced until after the signal output 91 is in the H region then a pulse of the auxiliary pulse train sequence T' appears which is after a correctional step has been carried out.

In the command computer 47 a counting circuit 102 is additionally provided for the generation of the control command "information pickup". With the aid of this counting circuit 102, the location of the sites of the pickup of the color speciment information from the pattern elements 4 can be set by adjusting a switch panel field 103 as a function of time. The pulse input 104 of the counting circuit 102 has the pulse sequence $T_a$ applied to it. The resetting of the counting circuit 102 occurs when a control command "scanning raster" is received at the input 105 of the counting circuit 102.

Figure 6:
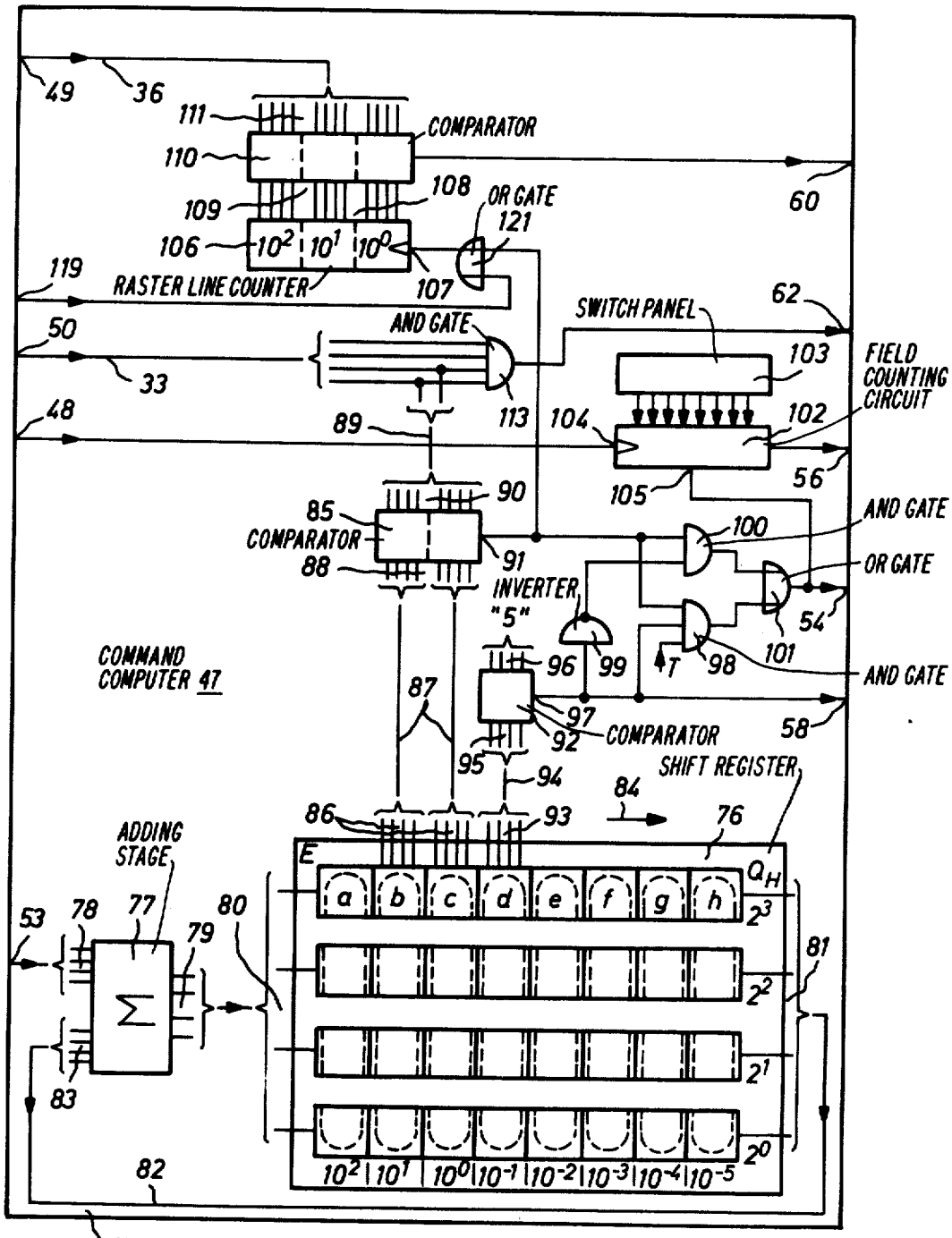
FIG. 6 illustrates a further sample embodiment of the command computer.

The counting circuit 102 is illustrated in FIG. 6. The control command "line end" is formed by comparing the number $x_2$ of pattern elements preset on the digital switch 35a with the number of vertical raster lines crossed over during the scanning of a scanning line or respectively, with the number of "scanning raster" control commands generated per scanning line. The number of "scanning raster" control commands is counted into a raster-line counter 106 which can be constructed as three cascaded decimal counters of SN 7490 and such counter will have a counting capacity of three decades. For counting, the signal output 91 of the comparator 85 is connected to the pulse input 107 of the raster line counter 106.

The outputs 108 of the raster line counter 106 are connected to the A-inputs 109 of a further comparator 110 which has its B-inputs 111 connected to the digital switch 35a through line 36. The comparator 110 generates at its output 60 a signal comprising the control command "line end".

Since the counter reading $x = 0$ of the horizontal step counter 27 in each case indicates the beginning of a line, the control command "line beginning" will be formed by the coding-out of the outputs 31 of the horizontal step counter 27 with the aid of an AND gate 113. It is advantageous to display the counter readings "zero" of the horizontal and vertical step counters since the display facilitates for the operator, the positioning of the scanning device 7 to the starting points $P'_0$ at the beginning of the scan.

FIGS. 4A through E illustrate in graphic representation the mode of operation of the horizontal arithmetic unit 26a.

Figure 4:
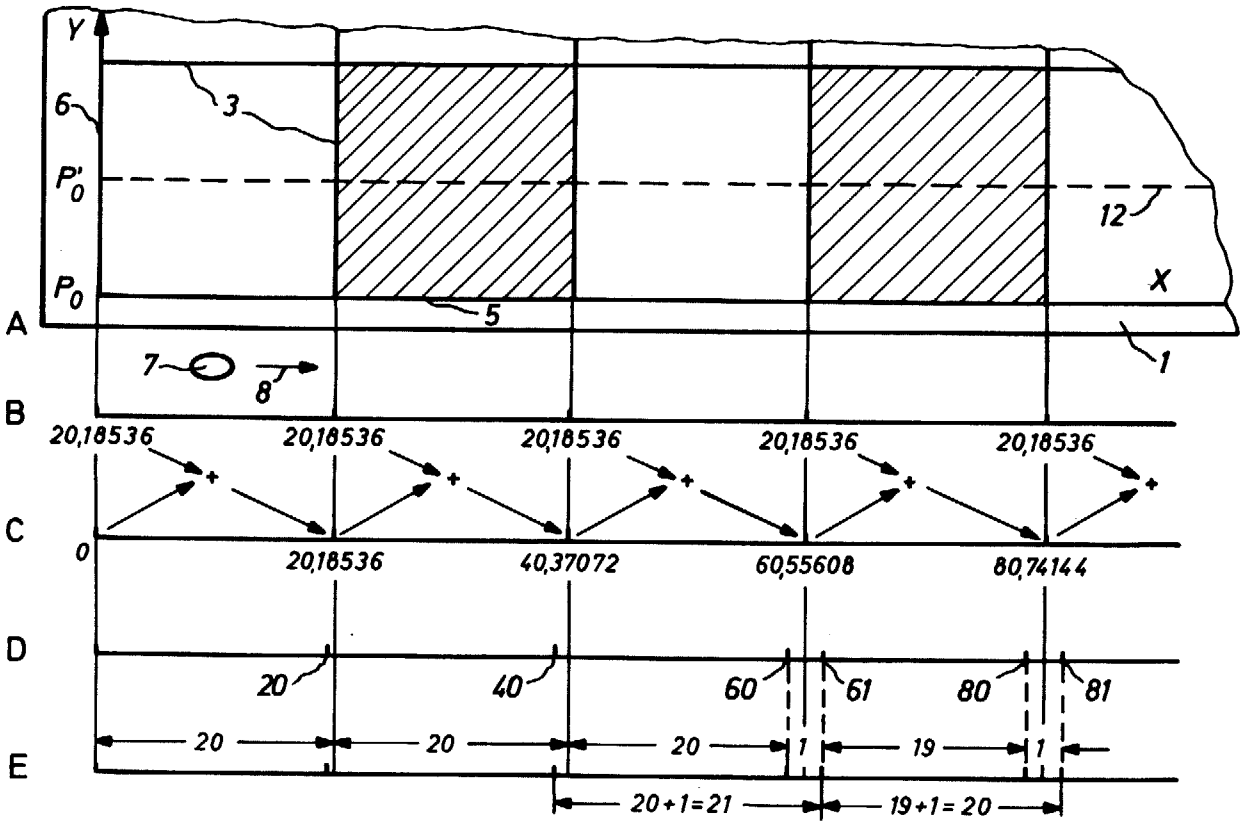
FIGS. 4A through E are graphical representations for describing the invention.

In FIG. 4A, a segment of the point paper design pattern 1 to be scanned, is illustrated with several pattern elements 4 of the first scanning line 12. During scanning, the scanning member 7 will move along the point paper design pattern 1 parallel to the X-axis in the direction of the arrow 8.

FIG. 4B is a plot of the calculated quotient $q_x$ from the repeat length $x_1$ of the point paper design pattern 1 and the prescribed number $x_2$ of pattern elements 4 per repeat length. The quotient $q_x$ corresponds to the specified number of advancement steps of the scanning device in the direction of the X-axis. In a specific example let it be assumed that the quotient $q_x = 20.18536$ which has been calculated and is stored in the shift register 32.

In FIG. 4C, the result of the continuous summing up of the quotient $q_x$ is plotted and the addition operations are indicated by the arrows. The addition results correspond in each case to the specified number of completed advancement steps (advancement steps covered) of the scanning member 7 from the beginning of the scanning line at point $P_0$ up to the assigned vertical raster line.

In FIG. 4D, the actually executed number of advancement steps of the scanning member 7 from the beginning of the scanning line at point $P_0$ up to the corresponding vertical raster line is indicated and the number of the advancement steps corresponds to the running counter reading "$x$" of the horizontal step counter 27.

In FIG. 4E, the number of the executed advancement steps of the stepping motor 13 as well as the advancing steps of the scanning member 7 per pattern element 4 is illustrated. After scanning of the first pattern element, the scanning member 7 will have carried out 20 advancement steps and the counter reading of the horizontal step counter 27 will be X = 20. At this time, the prescribed number, however, will equal 20.18536 so that the scanning member 7 will be somewhat behind its desired specified position.

For scanning the second pattern element, the scanning member 7 again requires 20 advancement steps. At the end of the second pattern element, the counter reading will therefore be X = 40; and the prescribed number of executed advancement steps, however, will be 40.37072. The error has thus increased. After 20 further advancement steps, the counter reading will be X = 60 and the prescribed number 60.55608. The error between the actual and the prescribed position at this time will be greater than 0.5 and, thus, the comparator 92 of the command computer 47 will emit the control command "correctional step" and the scanning member 7 will executed an additional advancement step.

The number of advancement steps for the third pattern element thus will add up to 21 and the counter reading will illustrate X =61.

After 19 additional advancement steps have been made, the counter reading will be X = 80 and the calculated prescribed number will be 80.77144. A correctional step will again be made which raises the counter reading to X = 81. For the scanning of the fourth pattern element, 20 advancement steps are therefore required.

The graphic illustration indicates how position errors are avoided by the insertion of an additional correctional step and how precise scanning of a point paper design pattern becomes possible so as to compensate and adjust for position errors which result from the fact that the scanning member 7 can in each instance only carry out whole number of advancement steps whereas the specified number of advancement steps exactly calculated from the length errors of the pattern will generally be a decimal fraction.

Figure 5:
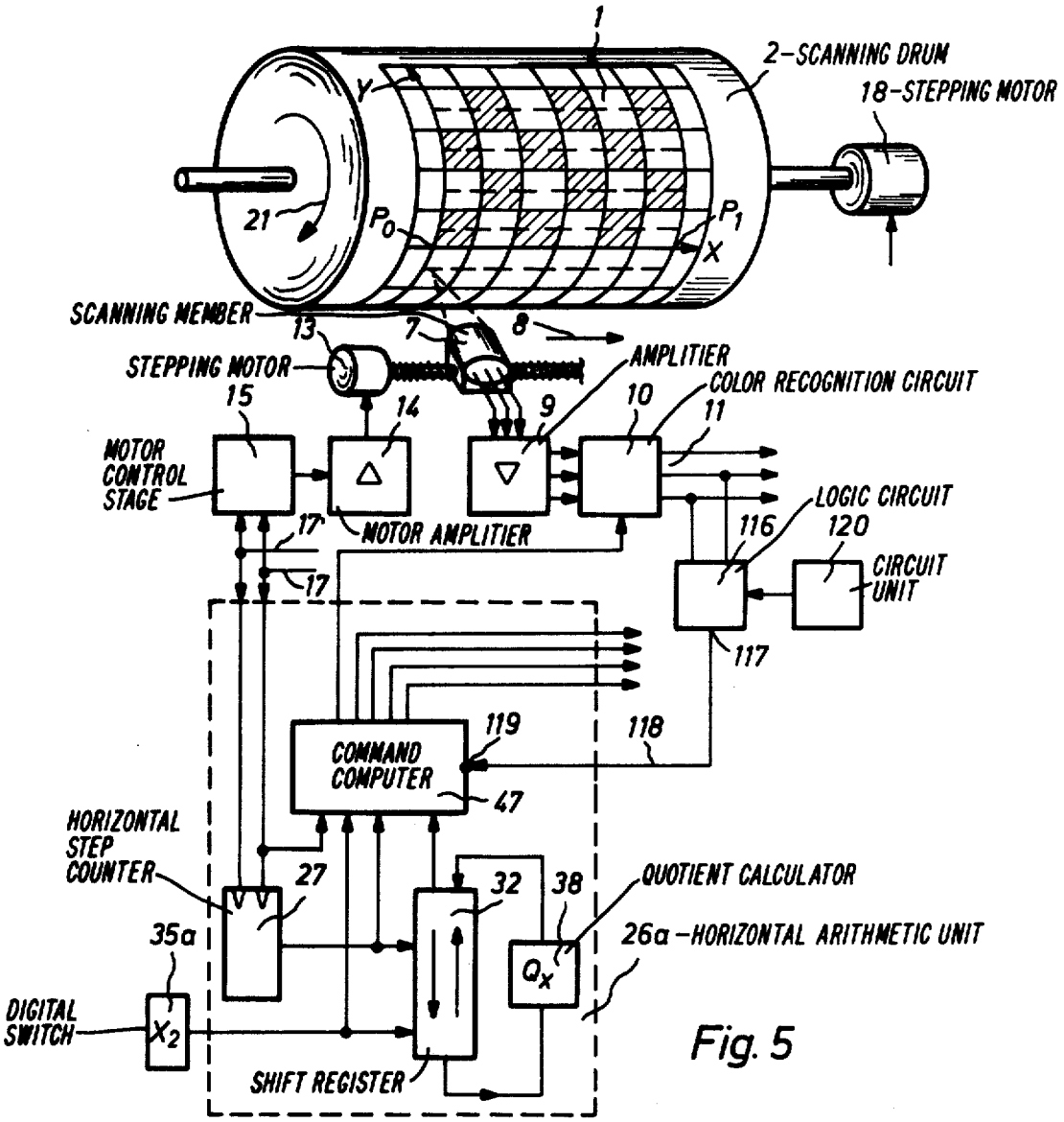
FIG. 5 illustrates a modified form of the point pattern design scanning device.

FIGS. 5 and 6 illustrate an embodiment of the invention which makes possible an automatic measurement of the repeat length $x_1$ and the repeat length $y_1$ of the paper point design pattern 1 before scanning. Only the operation for measuring the repeat length $x_1$ will be described in detail since the measurement of the repeat height $y_1$ is accomplished in a similar fashion.

FIG. 5 illustrates the fundamental structure of the paper point design scanning device in block circuit form.

Before the measurement starts, the operator positions the scanning member 7 to the coordinate zero point $P_0$ by using the push button panel 24 and particularly the push button groups 29 and 30 illustrated in FIG. 1. In response to a corresponding command, the scanning member 7 automatically traverses the measurement distance bordered by points $P_0$ and $P_1$ in this instance outside of the surfaces covered by the pattern elements, but inside the raster line network for the point paper design pattern 1. During the advancing movement of the scanning member 7 along the scanning line 12, the number of pattern elements 4 passed over by the scanning member 7, are respectively the vertical raster lines of the point paper design pattern are counted and compared to the number $x_2$ of pattern elements per repeat length preset on the digital switch 35*a*. When these values are equal, the scanning member 7 will automatically be stopped. The attained position of the scanning device 7 corresponds to the point $P_1$ of the point paper design pattern 1.

During the advancement of the scanning member 7, the horizontal step counter 27 of the horizontal arithmetic unit 26*a*, will have steadily counted the number of advancement steps and at position $P_1$ of the scanning member 7, the counter reading will correspond to the desired total number $x_1$ of advancement steps per repeat length.

The commands for a quotient formation in the quotient calculator 38 and for returning the scanning member 7 to the starting point $P'_0$ of the first scanning line before scanning of the point paper design pattern 1 can be automatically accomplished.

In the process of the measuring operation, the vertical raster lines are detected by the scanning member 7 and electrical color signals will be formed and appear at the outputs 11 of the color recognition circuit 10 which corollate to the colors "white" and "black". The color signals are fed to a logic circuit 116 which produces a raster pulse sequence at an output 117 during scanning of the raster lines. The raster pulse sequence is fed to an input 119 of the command computer 47 through a line 118.

Raster lines from the point paper design pattern which are poorly expressed, will not disturb the measurement operation because a circuit unit 120 is provided for the recognition of interruptions in the detected raster lines. The circuit unit 120 contains a controlled generator which inserts the missing pulses at those points where a raster line is missing if a pulse in the raster pulse sequence is absent.

In FIG. 6 the circuit arrangement for the processing in the command computer 47 of the raster pulse sequence generated by the logic circuit 116 is illustrated. This circuit arrangement is very similar to that illustrated in FIG. 3 with the exception that an additional OR gate 121 is connected ahead of the pulse input 107 of the raster line counter 106. The input 119 of the command computer 47 at which the raster pulse sequence is present is connected to the pulse input 107 of the raster line counter 106 through the OR gate 121.

In the comparator 110, the number of raster lines recognized during the measurement operation which number is equal to the number of pattern elements passed by the scanning member 7 is compared to the preset number of pattern elements per repeat length. When these are equal, the comparator 110 emits the control command "line end" through its signal output 60 which command terminates the measurement operation.

Figure 7:
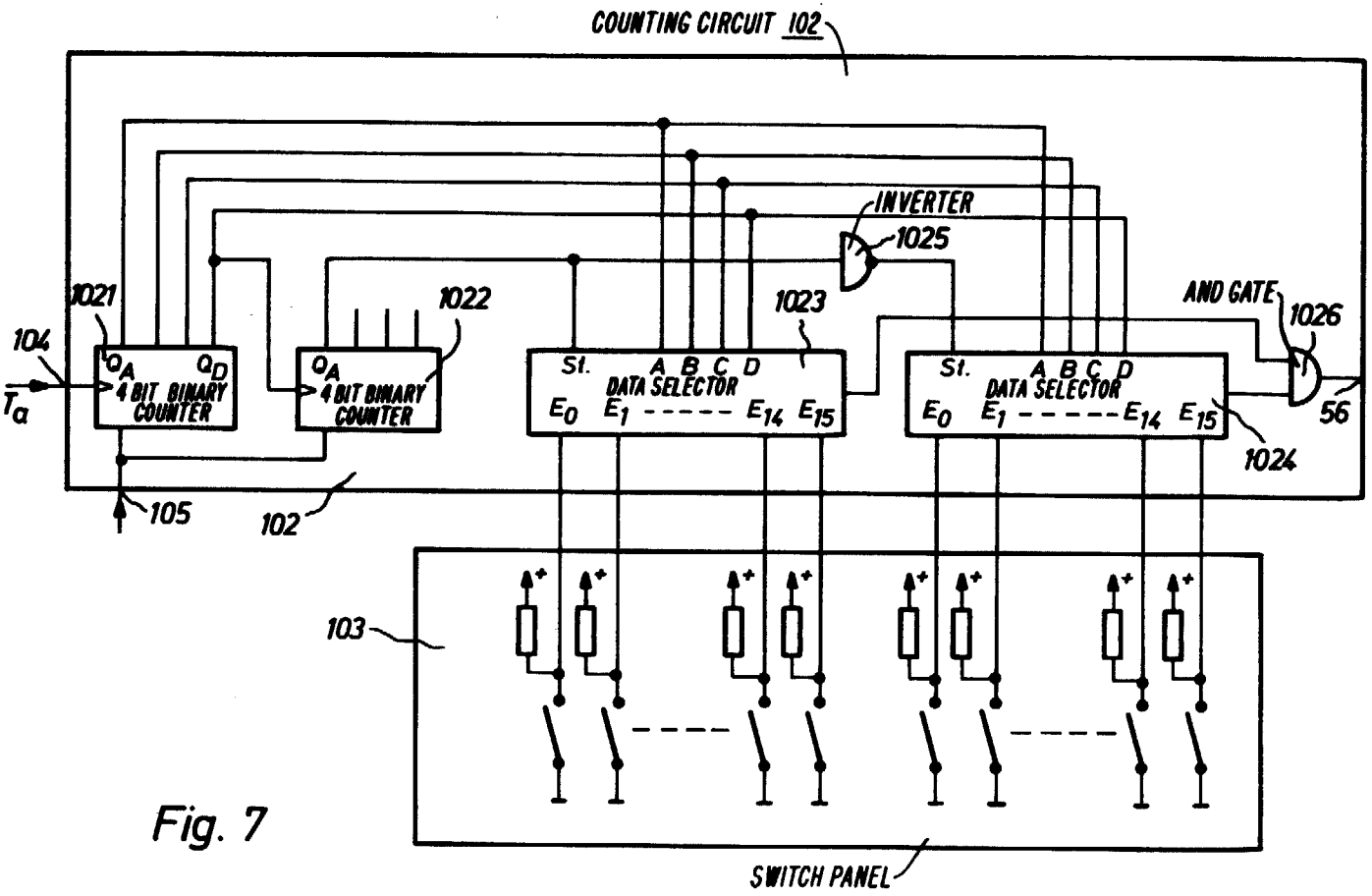
FIG. 7 is a diagram of a counting circuit used in the invention.

FIG. 7 illustrates a sample embodiment of the counting circuit 102 and of the switch panel 103. The counting circuit 102 is constructed of two 4 bit binary counters 1021 and 1022 which might, for example, be of type SN 7493. Two data selectors 1023 and 1024 which might be, for example, type SN 74150 are also part of the counting circuit 102.

The pulse input 104 of the counting circuit 102 is identical to the pulse input T of the first binary counter 1021. The outputs $Q_A$ to $Q_D$ of the binary counter 1021 are connected to the selection input A to D of the data selectors 1023 and 1024. The output $Q_D$ of the first binary counter 1021 is connected to the pulse input T of the second binary counter 1022. The output $Q_A$ of the second binary counter 1022 is connected to the strobe input of the data selector 1023 and to the strobe input of the data selector 1024 through an inverter 1025. Resetting of the binary counters 1021 and 1022 is accomplished through the reset inputs 105 of the counting circuit 102. The outputs Q of both data selectors 1023 and 1024 are combined through an AND gate 1026 and supplied to the output 56 of the counting circuit 102. The data inputs $E_0$ to $E_{15}$ of the data selectors 1023 and 1024 can through setting of the switches of the switch panel 103 be connected either to the mass potential (L-Signal) or through resistors to the positive pole of a supply voltage source (H-signal). The signals simultaneously present at the data inputs $E_0$ to $E_{15}$ of the data selectors can be binarily selected from the selection inputs A to D and appear in inverted form in serial sequence at the outputs Q.

The pulse train sequence $T_a$ appearing at the pulse input 104 of the counting circuit 102 will have one or several pulses selected from it which selection is determined by the setting of the switches of the switch panel 103. If, for example, the fifth pulse of the pulse train sequence $T_a$ is to appear at the output 56, then the data input $E_5$ of the data selector 1023 will be applied to the mass potential.

The selection of up to the sixteenth pulse of the pulse train sequence $T_a$ is accomplished with the switches assigned to the data selector 1023 whereas the selection of the pulses from 17 to 32 is selected by the switches of the switch panel 103 assigned to the data selector 1024.

The selected pulse at the output 50 of the counting circuit 102 corresponds to the control command "information pickup" and when it appears the color recognition circuit 10 evaluates the color information from a pattern element 4 which has just been scanned on the scanning line.

Since an advancement step of the scanning member 7 corresponds to each pulse of the pulse sequence $T_a$ the particular location of the specimen pickup from the pattern 4 can also be determined along a scanning line with the aid of the counting circuit 102.

The number of advancement steps required by the scanning member 7 for passing over a sample element 4 which number is equal to the quotient $q_x$ will be displayed on the display unit 383 of the quotient calculator 38.

By evaluating this display and corresponding actuation of a switch of the control panel 103, the operator can locate the pickup of the scanning device 7 approximately in the middle of a pattern element 4 for color pickup. If, for example, the quotient $q_x = 20$ is displayed, then the operator will put the data input $E_{10}$ of the data selector 1023 on mass potential.

For increasing the recognition accuracy of a color during the scanning of a point paper design pattern, it is advantageous to derive several color specimens within a pattern element 4 and to evaluate them in a logic circuit so as to eliminate erroneous color determinations. The number and location of the sample specimens picked up from a pattern element 4 can be selected in an advantageous manner with the counting circuit 102. In logic circuits, a majority decision can be carried out from the sample color specimens obtained during the multiple sample scanning and the color which was recognized most frequently inside a pattern element is selected as the true color for the pattern element 4. It is also possible to preselect a recognition accuracy in the logic circuit such that it is established the number of color sample specimens derived which must have the same color in order to reach a color decision. If for example, ten color sample specimens are derived from a pattern element 4 and if the recognition accuracy is established at a criteria of 5, then at least five of the color specimens must coincide for a color decision to be made.

The ratio of the number of color sample specimens per pattern element 4 to the preselected number of correspondence is a criteria for the quality of the scanning of a point paper design pattern.

If the logic circuit does not make an unequivocal determination from the sample color specimens of a pattern element 4, a message "color not recognized" can be generated and the advancement of the scanning member 7 could be stopped at that exact point. In such a case, the operator could by visual observation determine the correct color of the pattern at that point and can manually supply such information by actuating corresponding color buttons on the control panel.

It is seen that this invention provides a new and novel method and apparatus for scanning of patterns. Although this invention has been described with respect to preferred embodiments, it is not to be so limited, as changes and modifications may be made which are within the full intended scope as defined by the appended claims.

We claim as our invention:

1. A process for scanning a pattern by a scanning member moving relatively to the pattern in individual steps, wherein said pattern is divided into a plurality of fictitious meshes enclosed by raster lines of an imaginary scanning raster, and in which before scanning, the necessary number of steps corresponding to the width of one mesh in a first step direction is obtained by forming a quotient from the number of steps corresponding to the length of the pattern in said step direction and from the number of meshes in said step direction, and wherein the calculation of quotients is made for both said first step dimension and a second dimension of the pattern, forming multiples of said quotients, each of said multiples associated with a fictitious raster line which determines the necessary number of individual steps from the scanning start to said raster line, and wherein the numbers of steps which are carried out during scanning in said first and second dimensions of the pattern are counted and compared to the respective multiples of said quotients, and when these are equal or deviate from a predetermined fraction of an individual step, a signal is generated which indicates the beginning of the next adjacent raster line of the imaginary scanning raster and wherein upon a greater deviation than said predetermined fraction the signal is utilized after an additional step has been accomplished.

2. A process according to claim 1, wherein the number of steps, which are carried out from the scanning start in said step direction, is counted, and wherein the number of existing raster lines in step direction of a rastered pattern is counted by recognition of the black-white-transitions of said raster lines by said scanning member, and wherein the counted number of raster lines is continuously compared to the known number of existing raster lines in the pattern, and wherein when these are equal the counting of the steps is terminated, and said counted number of steps correspond to the length of the pattern in step direction.

3. A process according to claim 1 wherein before scanning the pattern said multiples of the quotients are calculated and stored in a storage means.

4. A process according to claim 1 wherein during scanning the pattern said multiples of the quotients are calculated by successively adding the quotients to the previously formed multiples.

5. A process according to claim 1, wherein during scanning the pattern, starting from the respective point in time of generation of said signal indicating the beginning of the next mesh, the point in time for sampling information from the mesh and the number of samples within said mesh are selectable.

6. A process according to claim 5, wherein the length of a mesh in said scanning direction is devided into a number of representative scanning pulses which is determined by the maximum number of samples per mesh, and wherein said scanning pulses are supplied to a selection circuit so as to select the pulses at which a sample is desired.

7. A process according to claim 6, wherein the number of scanning pulses correspond to the number of individual steps per mesh in the scanning direction.

8. A process according to claim 1, wherein the number of signals which indicate respectively the beginning of a next mesh is counted during scanning and continuously compared with the known number of meshes in the pattern in said step direction and wherein when these are equal a signal is geneated indicating the end of scanning.

9. A process for scanning a pattern by a scanning member moving relatively to the pattern in individual steps, wherein said pattern is divided into a plurality of fictitious meshes enclosed by raster lines of an imaginary scanning raster, and in which before scanning, the necessary number of steps corresponding to the width of one mesh in a first step direction is obtained by forming a quotient from the number of steps corresponding to the length of the pattern in said step direction and from the number of meshes in said step direction, and wherein the calculation of said quotient is carried out for one dimension of the pattern, forming multiples of said quotient, each of said multiples associated with a fictitious raster line determined by the necessary number of individual steps from the scanning start to said raster line, and wherein the number of steps which are carried out during scanning in one dimension of the pattern is counted and compared to the respective multiples of said quotient, and when these are equal or deviate from a predetermined fraction of an individual step a signal is generated which indicates the beginning of the next mesh of the imaginary scanning raster and wherein upon a greater deviation than said predetermined one the signal is given after an additional step has been accomplished.

10. A process according to claim 9 wherein the number of steps, which are carried out from the scanning start in said step direction, is counted, and wherein the number of existing raster lines in step direction of a rastered pattern is counted by recognition of the black-white-transitions of said raster lines by said scanning member, and wherein the counted number of raster lines is continuously compared to the known number of existing raster lines in the pattern, and wherein when these are equal the counting of the steps is terminated, and said counted number of steps correspond to the length of the pattern in the step direction.

11. A process according to claim 9 wherein before scanning the pattern said multiples of the quotients are calculated and stored in a storage means.

12. A process according to claim 9 wherein during scanning the pattern said multiples of the quotients are calculated by successively adding the quotients to the previously formed multiples.

13. A process according to claim 9 wherein during scanning the pattern, starting from the respective point in time of generation of said signal indicating the beginning of the next mesh, the point in time for sampling information from the mesh and the number of samples within said mesh are selectable.

14. A process according to claim 13, wherein the length of a mesh in said scanning direction is divided into a number of representative scanning pulses which is determined by the maximum number of samples per mesh, and wherein said scanning pulses are supplied to a selection circuit so as to select the pulses at which a sample is desired.

15. A process according to claim 14, wherein the number of scanning pulses correspond to the number of individual steps per mesh in the scanning direction.

16. A process according to claim 9 wherein the number of signals which indicate respectively the beginning of a next mesh is counted during scanning and continuously compared with the known number of meshes in the pattern in said step direction and wherein when these are equal a signal is generated indicating the end of scanning.

17. Apparatus for converting a point paper design pattern for weaving into stored information comprising:

a holding means to which said point paper design pattern can be attached, an electro-optical scanning means, a first step advancing means for advancing said scanning means in a first direction, a first direction step counting means connected to said scanning means, a second step advancing means for advancing said holding means in a second direction normal to said first direction, said point paper design being mounted on said holding means such that it is aligned in said first and second directions.

means for measuring the number of steps in said pattern in said first direction, means for setting the number of pattern elements in said point paper design pattern in said first direction, quotient determining means receiving the output of said measuring means and said setting means to determine a quotient, and a command computer receiving and summing the quotient output as the scanning means advances over each pattern element and also receiving the output of said first direction means and advancing said scanning means one additional step whenever the summed quotient has a fraction portion greater than a preset value.

18. Apparatus according to claim 17 including a missing raster line generator connected to said command computer.

19. Apparatus according to claim 17 wherein said command computer controls said first and second step advancing means and said scanning means.

* * * * *